US012460498B2

(12) United States Patent
Njærheim et al.

(10) Patent No.: US 12,460,498 B2
(45) Date of Patent: Nov. 4, 2025

(54) SYSTEM AND METHOD FOR REMOTELY CONTROLLING A RUNNING TOOL

(71) Applicant: Fox Subsea AS, Bryne (NO)

(72) Inventors: Kjetil Storhaug Njærheim, Sandnes (NO); Jan-Robert Lingjærde, Sola (NO); Bjørn Tore Lien, Bryne (NO); Kenneth Thunheim, Nærbø (NO); Thomas Aunvik, Kleppe (NO)

(73) Assignee: Fox Subsea AS, Bryne (NO)

( * ) Notice: Subject to any disclaimer, the term of this patent is extended or adjusted under 35 U.S.C. 154(b) by 0 days.

(21) Appl. No.: 18/711,213

(22) PCT Filed: Nov. 15, 2022

(86) PCT No.: PCT/NO2022/050261
§ 371 (c)(1),
(2) Date: May 17, 2024

(87) PCT Pub. No.: WO2023/091022
PCT Pub. Date: May 25, 2023

(65) Prior Publication Data

US 2025/0020037 A1 Jan. 16, 2025

(30) Foreign Application Priority Data

Nov. 19, 2021 (NO) ..... 20211390

(51) Int. Cl.
*E21B 33/035* (2006.01)
*E21B 33/043* (2006.01)
(Continued)

(52) U.S. Cl.
CPC ..... *E21B 33/0355* (2013.01); *E21B 33/043* (2013.01); *E21B 41/04* (2013.01); *E21B 47/13* (2020.05)

(58) Field of Classification Search
CPC .... E21B 33/0355; E21B 33/043; E21B 41/04; E21B 47/13
See application file for complete search history.

(56) References Cited

U.S. PATENT DOCUMENTS 7,318,480 B2 * 1/2008 Hosie ..... E21B 43/013 166/255.2
7,762,338 B2 * 7/2010 Fenton ..... E21B 47/09 166/368
(Continued)

FOREIGN PATENT DOCUMENTS

GB 2502158 A * 11/2013 ..... E21B 47/13
WO 2014011823 A1 1/2014
(Continued)

OTHER PUBLICATIONS

Search Report for Corresponding Norwegian Publication No. 20211390, dated Jun. 17, 2022.
(Continued)

*Primary Examiner* — Matthew R Buck
(74) *Attorney, Agent, or Firm* — ANDRUS INTELLECTUAL PROPERTY LAW, LLP

(57) ABSTRACT

A system is for remotely controlling a running tool to install equipment in a subsea well through a subsea structure. The system has a control device for controlling the running tool and a communication module for wirelessly communicating with the control device. The control device and the communication module include wireless communication interfaces for communicating subsea with each other through the subsea structure when the control device is provided internally to the subsea structure and the communication module is provided externally to the subsea structure. The memory of the control device is configured with state identifiers for representing internal states of the running tool and programs associated with operations for controlling the running tool.
(Continued)

The control device is configured to receive commands from the communication module, execute the programs based on the command, and return a state identifier for representing a current internal state of the running tool.

20 Claims, 4 Drawing Sheets

(51) Int. Cl.
*E21B 41/04* (2006.01)
*E21B 47/13* (2012.01)

(56) References Cited

U.S. PATENT DOCUMENTS

| | | | | |
|---|---|---|---|---|
| 8,511,389 | B2 * | 8/2013 | Fenton | E21B 33/0385 166/341 |
| 10,890,043 | B2 * | 1/2021 | Carlsen | E21B 47/12 |
| 2012/0000664 | A1 | 1/2012 | Nas | |
| 2013/0083627 | A1 | 4/2013 | Yates | |
| 2013/0088362 | A1 * | 4/2013 | Yates | E21B 47/13 340/854.3 |
| 2016/0305232 | A1 | 10/2016 | Bird | |
| 2016/0319657 | A1 * | 11/2016 | Szpunar | E21B 47/095 |
| 2017/0362910 | A1 * | 12/2017 | Stephens | E21B 33/143 |
| 2020/0240220 | A1 * | 7/2020 | DeBerry | E21B 19/165 |

FOREIGN PATENT DOCUMENTS

| | | | |
|---|---|---|---|
| WO | 2016182449 | A1 | 11/2016 |
| WO | 2020009697 | A1 | 1/2020 |
| WO | 2021048181 | A1 | 3/2021 |

OTHER PUBLICATIONS

International Search Report and the Written Opinion for Corresponding International Application No. PCT/NO2022/050261, dated Feb. 7, 2023.

International preliminary Report on Patentability for Corresponding International Application No. PCT/NO2022/050261 dated Jan. 2, 2024.

Response to the Written Opinion for Corresponding International Application No. PCT/NO2022/050261, dated Apr. 24, 2023.

Extended European Search Report for EP Application No. 22893983.1, dated Sep. 9, 2025.

* cited by examiner

SYSTEM AND METHOD FOR REMOTELY CONTROLLING A RUNNING TOOL

CROSS-REFERENCE TO RELATED APPLICATIONS

This application is the U.S. national stage application of International Application No. PCT/NO2022/050261, filed Nov. 15, 2022, which international application was published on May 25, 2023, as WO 2023/091022 A1 in the English language. The International Application claims priority to Norwegian Patent Application No. 20211390, filed Nov. 19, 2021. The international application and Norwegian application are both incorporated herein by reference, in their entirety.

FIELD

The present invention relates to a system for remotely controlling a running tool to install equipment in a subsea well through a subsea structure. The present invention also relates to a method of remotely controlling a running tool to install equipment in a subsea well through a subsea structure.

BACKGROUND

An important activity in the offshore petroleum industry is operating a running tool for setting equipment on a wellhead or on a wellhead module such as a valve tree (also known as Christmas tree) of a subsea well. One example of a running tool operation is setting a tubing hanger with the help of a tubing hanger running tool being controlled from a floating vessel. The tubing hanger is a device that is typically attached to the topmost tubing joint in a wellhead and that supports a tubing conduit within a wellbore under the wellhead. Once set, the tubing hanger is part of a sealing system which ensures that the tubing conduit and annulus are hydraulically isolated.

When this type of operation is carried out, there is a need for the running tool to receive power, often in the form of hydraulic and/or electric power, and network connections for exchanging data and control signals with a control system on the floating vessel. A well-known approach for supplying power to and communication with a running tool is to provide an umbilical between the floating vessel and the running tool. Electric and/or hydraulic power units are provided on the floating vessel, and these power units transmit power to the running tool via the umbilical. Also, the umbilical allows an operator to control the running tool, e.g. through an optical fiber cable. This approach is known to have several drawbacks. Firstly, the offshore operations related to establishing the umbilical require drilling rig workers to enter the "red zone" of the drilling rig in order to perform tasks such as clamping the umbilical to the drill pip. The entrance into the red zone of a drilling rig entails safety risks. Also, these tasks take time to perform, which is expensive an offshore context. Secondly, the umbilical is challenging to use and operate. The outside of an umbilical typically ranges from 25 to 100 mm, and it is not unusual for the umbilical to include 10 to 20 separate hydraulic lines, in addition to electric cables for transmitting electric power and further network cables for communication. The umbilical line can require large amounts of space on the deck of the floating vessel which could be utilized for other equipment. Thirdly, the umbilical can be damaged due to large mechanical stresses caused by the floating vessel and the marine riser moving because of environmental loads, such as waves and sea currents. Fourthly, the use of an umbilical also poses risks of damage to the production tubing or downhole equipment.

It can be challenging to provide an alternative to controlling a running tool using the well-known umbilical cable approach.

A known alternative approach is disclosed in WO 2016/182449 A1, which generally aims to replace the umbilical by providing alternative means for achieving all the same functions as those achieved by the umbilical. For providing power to the running tool, this document discloses providing the hydraulic and/or electric power units in a localized manner and proximity to the running tool. Thus, the power unit(s) are also run-in hole and pulled out of hole together with the running tool. For providing communication between the floating vessel and the running tool, this document suggests using a "penetrator" approach, which includes providing a blow-out preventer with a transmitter placed between the inside and the outside of the blow-out preventer. Such a feedthrough can be provided through a choke, kill or booster port of a blow-out preventer, and is typically referred as a "penetrator". The penetrator approach has several drawbacks. Firstly, as described in page 6, third paragraph, this approach requires that the penetrator can withstand a high differential pressure between the high pressure inside the blow-out preventer and the hydrostatic water pressure at which the blow-out preventer is subjected on its outside. Secondly, the penetrator cannot be moved once installed on the blow-out preventer. Thirdly, a penetrator is limited to providing a communication channel through the structure of the blow-out preventer. Thus, a running tool will only be contactable after having already passed the flex joint connecting the marine riser and the blow-out preventer, which may be restrictive in several operations. Fourthly, providing a penetrator on a blow-out preventer can be a safety risk.

Another known approach generally relates to using wired drill pipe for providing communication between the floating vessel and the tubing hanger running tool. Wired drill pipe may comprise modified tubulars that include data cables along the internal diameter and inductive coils in the connection between tubulars for achieving inter-tubular communication. In practice, is has been observed that this approach is not as advantageous as expected, because it requires a lot of space on the deck of the floating vessel. Also, this approach requires personal to enter the red zone in order to perform operations.

SUMMARY

The invention will now be disclosed and has for its object to remedy or to reduce at least one of the drawbacks of the known prior art, or at least provide a useful alternative to the known prior art. The object is achieved through features, which are specified in the description below and in the claims that follow. The invention is defined by the independent patent claims, and the dependent claims define advantageous embodiments of the invention.

According to a first aspect of the invention, there is provided a system for remotely controlling a running tool to install equipment in a subsea well through a subsea structure. The system comprises:

a control device for controlling the running tool, the control device comprising a processing unit, a memory and a first wireless communication interface; and a communication module for wirelessly communicating with the control device, the communication module comprising a second wireless communication interface.

The first and the second wireless communication interfaces are adapted for subsea communication with each other through the subsea structure when the control device is provided internally to the subsea structure and the communication module is provided externally to the subsea structure. Also, the memory of the control device is configured with:

at least one state identifier for representing an internal state of the running tool; and at least one program, each program being associated with at least one operation for controlling the running tool.

Moreover, the control device is configured to carry out the following steps:

receiving a command from the communication module, the command identifying a program configured in the memory of the control device;

executing the at least one operation associated with the identified program;

processing a state identifier for representing a current internal state of the running tool; and sending the processed state identifier to the communication module.

It has been realized that controlling a running tool within a subsea structure, which may include for example a marine riser or a blow-out preventer, can be accomplished by providing: a control device configured with the programs for controlling the running tool to install the equipment; and wirelessly communicating with the control device through a subsea communication channel crossing the subsea structure, the communication being based on state identifiers for representing the internal state of the running tool. This solution counters the approach of continuously providing live feedback from the running tool to topsides, which requires a network capable of transmitting very high quantities of data to the floating vessel. Also, this solution is advantageous in that it overcomes the drawbacks previously observed. For example, this solution does not require personal on the floating vessel to enter the "red zone".

Each of the first and second wireless communication interfaces may comprise a magnetic induction antenna. Although the use of a magnetic induction antenna may achieve a lower data transmission rate than when using a network cable extending to the control device (via an umbilical) from the floating vessel, the use of state identifiers configured in the memory of the control device allows making use of the lower data transmission rate in an effective manner.

In one embodiment, the control device may be connected to the first wireless communication interface via a network cable.

The communication module may be installable on an external surface of the subsea structure.

The system may comprise a remotely operated vehicle adapted to carry the communication module underwater.

The system may comprise a remote-control device adapted to communicate with the control device via the communication module, the remote-control device comprising a processing unit and a memory configured with:

at least one command for identifying a program configured in the memory of the control device; and the at least one state identifier representing an operating state of the running tool.

The remote-control device may be adapted to communicate wirelessly, underwater with the communication module.

The system may comprise at least one energy storage device for providing power to the running tool.

According to a second aspect of the invention, there is provided a method of remotely controlling a running tool to install equipment in a subsea well through a subsea structure, the method comprising the steps of:

providing the equipment to be set in the subsea well;

providing the running tool;

providing a system as described in the first aspect of the invention;

arranging the equipment, the running tool and the control device of the system into an assembly for the installation of the equipment, wherein the control device is installed for controlling the running tool;

positioning the communication module of the system externally to the subsea structure; and positioning the assembly internally to the subsea structure so that the control device and the communication module may communicate subsea with each other through the subsea structure.

The method further comprises the steps of:

transmitting a command from the communication module to the control device, the command identifying a program configured in the memory of the control device;

controlling the running tool with the control device so that the at least one operation associated with the identified program is executed;

having the control device process a state identifier for representing a current internal state of the running tool; and sending the processed state identifier from the control device to the communication module.

The step of positioning the communication module of the system externally to the subsea structure may comprise a step of installing the communication module externally to the subsea structure.

In one embodiment, the step of providing a system as described in the first aspect of the invention comprises providing a system which comprises a remotely operated vehicle adapted to carry the communication module underwater. In that embodiment, the step of placing the communication module of the system externally to the subsea structure comprises the step of operating the remotely operated vehicle to place the communication module of the system externally to the subsea structure.

The step of arranging the equipment, the running tool and the control device of the system into an assembly may comprise the step of performing at least one test for confirming that the control device is adapted to control to the running tool.

The subsea structure may comprise a marine riser and/or a blow-out preventer. The equipment may be a tubing hanger and the running tool may be a tubing hanger running tool.

BRIEF DESCRIPTION OF THE DRAWINGS

Embodiments of the invention will now be described, by way of example only, with reference to the accompanying drawings, in which.

DETAILED DESCRIPTION OF THE EMBODIMENTS

Figure 1A:
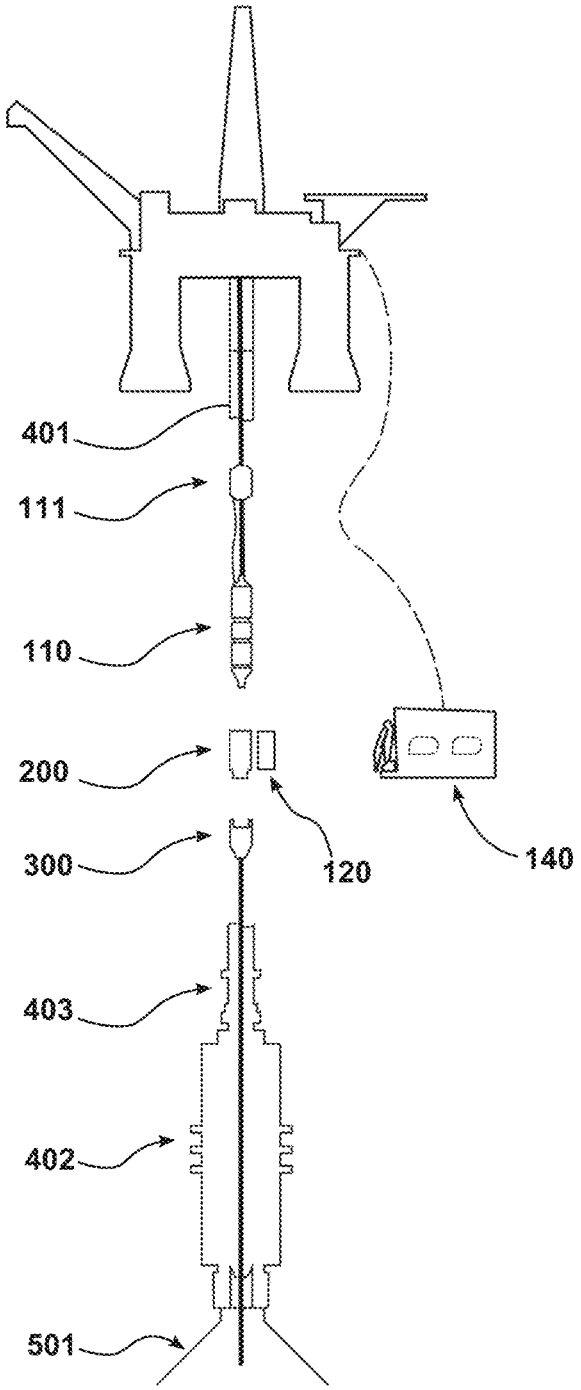
FIG. 1A is a schematic exploded elevation view of a system embodiment.
Figure 1B:
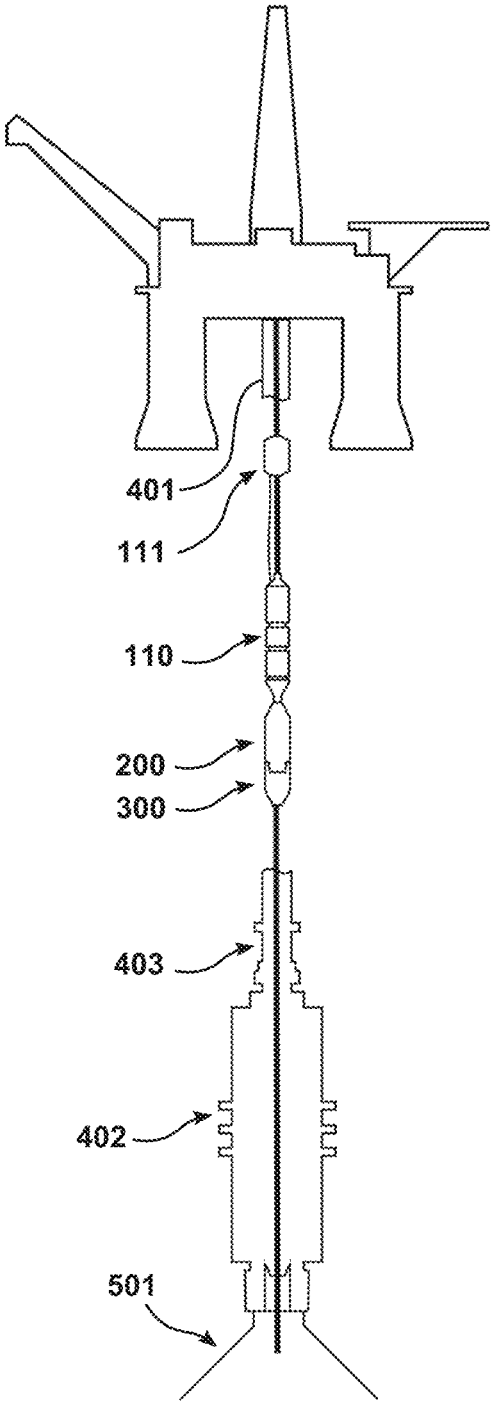
FIG. 1B is a schematic elevation view (in non-exploded assembly) of the system embodiment in FIG. 1A.

Turning now to FIGS. 1A and 1B, these show an operation example in which a system 100 embodiment is being used. FIGS. 1A and 1B are illustrated in exploded and non-exploded views, respectively. The operation example relates to lowering equipment 300 towards a subsea well. In this example, a tubing hanger 300 is being lowered from a semi-submersible platform (observable at the top of each of the two figures) to be installed on a well head 501 (observable at the bottom of each of the two figures).

It can be observed that there is a subsea structure 400 provided between the semi-submersible platform and the well head 501. In this operation example, the subsea structure 400 includes a marine riser 401, which is partly illustrated under the semi-submersible platform. The remaining portion of the marine riser 401 has been hidden for the purpose of improving the visualization of the devices and components shown in FIGS. 1A and 1B. At the lower end of the marine riser 401, the subsea structure includes a flex joint 403 for permitting relative angular movement of the marine riser 401 and reduce stresses due to motion and environmental forces transmitted from the semi-submersible platform. The flex joint 403 is provided at the top of a blowout preventer 402, which is installed on the well head 501. Thus, it can be observed that most of the devices and components shown between the upper portion of the marine riser 401 and the flex joint 403 are positioned within a portion of the marine riser 403 that is not shown in FIGS. 1A and 1B.

An assembly is being lowered from the semi-submersible platform, and this assembly includes the tubing hanger 300, which is the equipment that will be installed on the well head 501, a running tool 200 for setting the tubing hanger 300 on the well head 501, and a control device 110 for controlling the running tool 200. This assembly is being lowered within the marine riser 401, which, as already explained, is partly shown in FIGS. 1A and 1B. Once this assembly reaches the lower portion of the subsea structure 400, the control device 110 will be operated to control the running tool 200, which will in turn install the tubing hanger 300 on the well head 501. The installation operation is explained below with reference to FIGS. 2 and 3.

In some system 100 embodiments, there may also be included at least one energy storage device for providing power to the running tool 200. Such an energy storage device may include an electric and/or a hydraulic power unit. When such an energy storage device is included in the system 100, it is part of the assembly being lowered from the floating vessel, e.g. a semi-submersible platform. Also, the at least one energy storage device may be implemented as part of the control device 110.

The control device 110, which is being lowered in the assembly, is part of the system 100 embodiment shown in FIGS. 1A and 1B. The system 100 also includes a communication module 120 for wirelessly communicating with the control device 110 from the outside of the marine riser 401. In FIG. 1A, it is observable that the communication module 120 is, as an example, installed at a fixed position on the external surface of the marine riser 401. The skilled person will find many known ways for achieving such an installation on an external surface of a marine riser 401 or other parts of the subsea structure 400.

Each of the control device 110 and the communication module 120 includes a wireless communication interface embodiment, and this allows implementing a wireless communication channel between the control device 110 when the latter is provided within the subsea structure 400 (e.g. within the marine riser 401 in the situation shown in FIGS. 1A and 1B) and the communication module 120 when the latter is provided on the outside of the subsea structure 400. The wireless communication interface 111 (hereafter referred as the first wireless communication interface 111) of the control device 110 is shown, in FIGS. 1A and 1B, appearing closely above the control device 110 and connected by a data cable. The skilled person will know other ways of providing the control device 110 with the first wireless communication interface 111, such as by providing the first wireless communication interface 111 embedded on or attached to the body of the control device 110. The wireless communication interface 122 (hereafter referred as the second wireless communication interface 122) of the communication module 120 is not visible in FIGS. 1A and 1B. In this example, the second wireless communication interface 122 is embedded in the body of the communication module 120. The skilled person will also know other ways of providing the communication module 120 with the second wireless communication interface 122, such as by providing the second wireless communication interface 122 attached to the body of the communication module 120.

The two wireless communication interfaces are adapted for subsea communication with each other through the subsea structure 400 when the control device 110 is provided internally to the subsea structure 400 and the communication module 120 is provided externally to the subsea structure 400. In a preferred embodiment, each of the wireless communication interfaces 111,122 includes a magnetic induction antenna for communicating subsea and through at least one part of the subsea structure 400. In some embodiments, other wireless communication technologies can be used separately or in combination with the magnetic induction antenna.

In FIG. 1A, a remotely operated vehicle 140 is observable at a subsea position close to the communication module 120. In this embodiment, it is possible for an operator positioned on the semi-submersible platform to communicate with the control device 110 within the marine riser 401 through the communication module 120. In one embodiment, a communication network can be achieved by having the remotely operated vehicle 140 and the communication module 120 adapted to establish a communication connection, which can be accomplished in many know ways, such as via subsea electrical connectors or further wireless communication interfaces. The skilled person will know different ways of achieving the communication between the semi-submersible platform and the remotely operated vehicle 140, such as by cable or acoustic subsea wireless communication.

Figure 2:
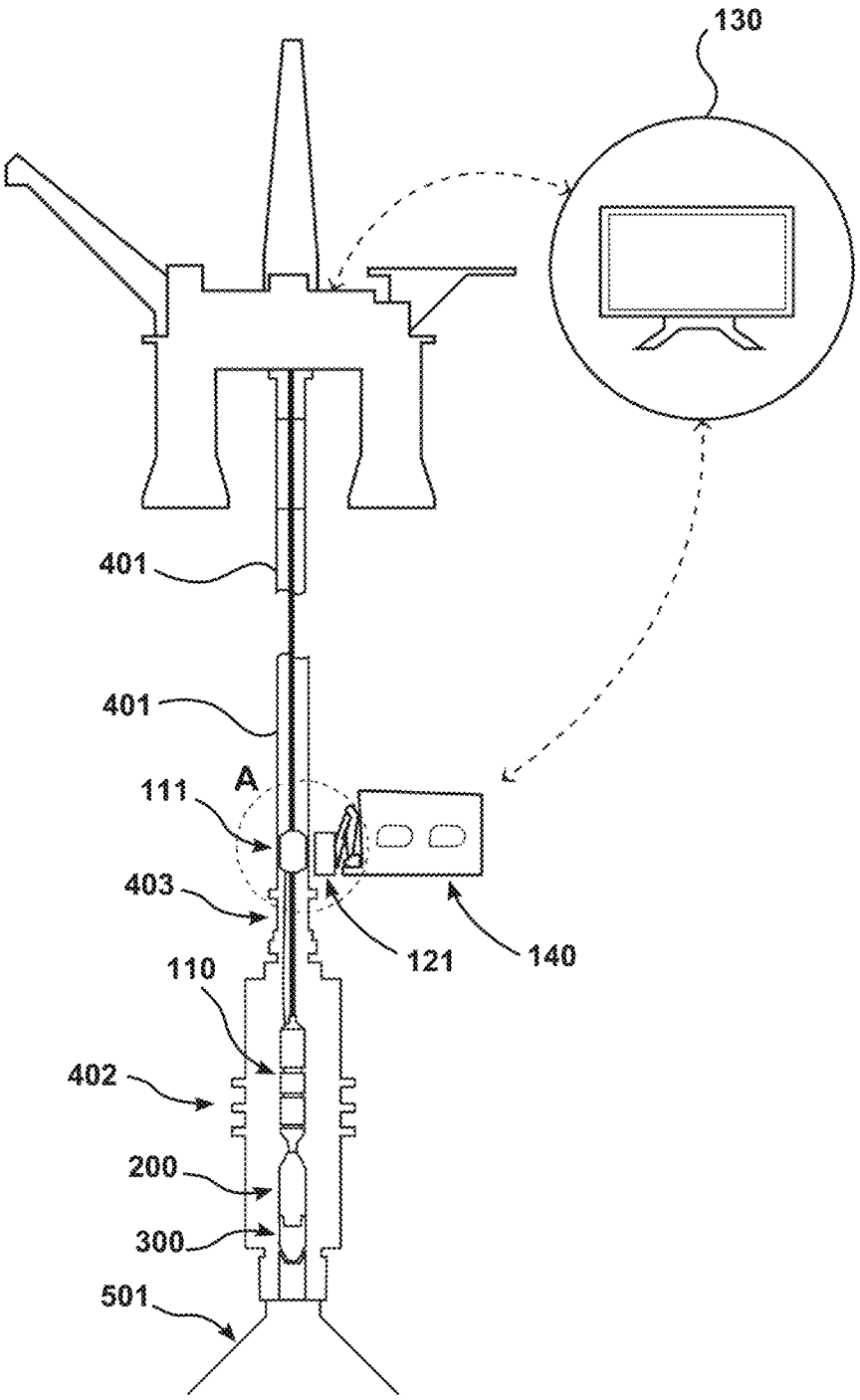
FIG. 2 is a schematic elevation view of a system embodiment during an installation operation.
Figure 3:
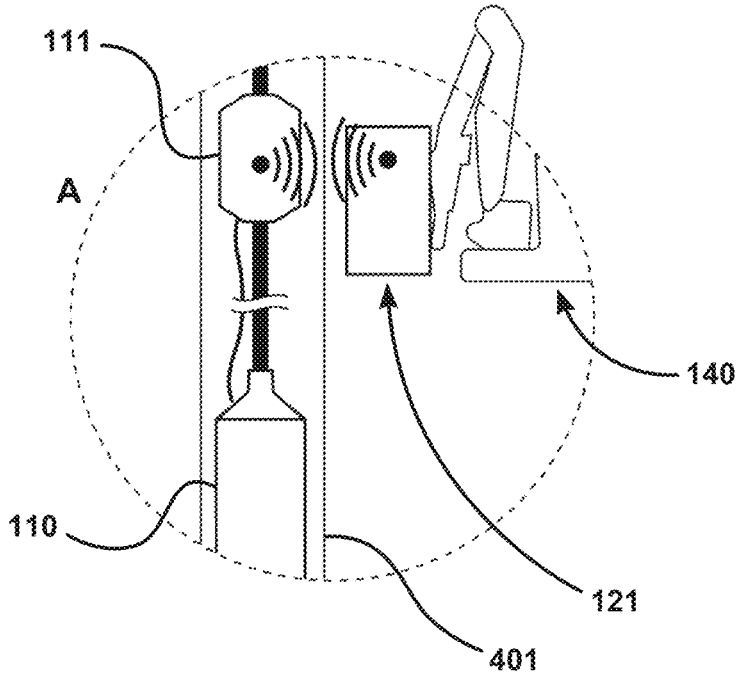
FIG. 3 is a schematic detail view of region A in FIG. 2.

FIGS. 2 and 3 show another system 100 embodiment being used during another operation example. In particular, the situation shown relates to an installation of equipment 300. A tubing hanger 300 has been lowered onto a well head 501, this being the location on which the tubing hanger 300 will be installed. FIG. 3 shows a detail view of region A in FIG. 2.

The memory of the control device 110 has been configured with at least one state identifier for representing an internal state of the running tool 200. For example, a state identifier may relate to a condition that is observable in the equipment 300, such as stating that a part of the equipment is at a certain position (e.g. "flange 1 is oriented"). The memory of the control device 110 is also configured with at least one program, each program being associated with at least one operation for controlling the running tool 200. With these memory configurations, the control device 110 can be commanded to carry out programs and to use state identifiers to report on the state of the running tool 200.

The system 100 embodiment shown in FIG. 2 includes a communication module 121 provided on a remotely operated vehicle 140 (see FIG. 3, in which the region A in FIG. 2 is schematically shown in more detail), whereas the system embodiment shown in FIGS. 1A and 1B includes its communication module 120 set on the external surface of a marine riser 401. In particular, the remotely operated vehicle 140 is adapted to carry the communication module 121. The skilled person will find many alternatives related to the installation of a communication module embodiment. For example, a communication module embodiment may be installed on an external surface of a blowout preventer 402 or another part of the subsea structure 400. Providing the communication module 121 on a remotely operated vehicle 140 is advantageous in that communication channels can be dynamically established at different locations of the subsea structure 400. For example, it can be highly advantageous, from an operational and safety point of view, to establish a first communication moment before the tubing hanger 300 reaches the flex joint 403 (i.e. above the flex joint 403) and a second communication moment after the tubing hanger 300 passes the flex joint 403 (i.e. under the flex joint 403).

It is also observable in FIG. 2 why it can be advantageous to provide a control device 110 embodiment including a first wireless communication interface 111 at a position above the control device 110 and connected by a network cable to the rest of the control device 110. This embodiment allows having the first wireless communication interface 111 positioned above the flex joint 403 while the tubing hanger 300 has been lowered onto the well head 501. Thus, the communication module 121 and the remotely operated vehicle 140 can stand away from the subsea region surrounding the blowout preventer 402 while still achieving control over the operations of the running tool 200 during installation.

In FIG. 2, a remote-control device 130 is schematically illustrated with relations to the semi-submersible platform and the remotely operated vehicle 140. The skilled person will know there are many ways for an operator to communicate from the floating vessel to the control device 110 via the communication module 121. The remote-control device 130 may be implemented by a portable computer and/or another computer system, the portable computer being positioned on the semi-submersible platform or another floating vessel. Also, the remote-control device 130 may be configured with software for making use of a communication system connected to the remotely operated vehicle 140 and another communication system to communicate with drilling rig operations, in which the positioning of the tubing hanger 300 relative to the semi-submersible platform is controlled. In another embodiment, the remote-control device 130 includes communicates wirelessly with the communication module 120,121 using acoustic wireless communication.

Operations

In one method embodiment, a running tool 200 can be remotely controlled to install equipment 300 in a subsea well through a subsea structure 400. Such a method embodiment can include three stages: a pre-operation stage, which includes steps for achieving an assembly that can be run into a subsea structure 400; a positioning stage, which includes steps for achieving a communication channel between a control device 110 positioned within the subsea structure 400 and a communication module 120,121 positioned externally to the subsea structure 400; and an execution stage, which includes steps for commanding the control device 110 to operate the running tool 200, possibly for controlling the running tool 200 to install the equipment 300.

In the pre-operation stage, the method includes the steps of providing the equipment 300 to be set in the subsea well, the running tool 200 to install the equipment, and a system 100 embodiment, for example, as described above with reference to FIGS. 1A-1B, 2, and 3. The equipment 300 to be installed may be a tubing hanger 300, as described above with reference to the figures. Also included in the method is a step for arranging the equipment 300, the running tool 200 and the control device 110 of the system 100 into an assembly for the installation of the equipment 300. In this assembly, the control device 110 is installed for controlling the running tool 200.

The skilled person will know obvious embodiments for the pre-operation stage. For example, the skilled person may prefer to perform some or all the stage steps onshore and prior to departure to the semi-submersible platform. This can be advantageous in that it minimizes the complexity and duration of the offshore work. Also, the pre-operation stage may include the step of function testing the arranged assembly. For this purpose, a communication module 120,121 embodiment may be provided and used for establishing a communication channel with the control device 110 without being subsea nor having the subsea structure 400 standing between the communication module 120,121 and the control device 110.

In the positioning stage, the method includes the step of positioning the communication module 120,121 externally to the subsea structure 400. As described above with reference to FIGS. 1A-1B and 2, one embodiment for this positioning step is installing a communication module 120 at a fixed location externally to the subsea structure 400, for example on the external surface of a marine riser 401 or a blow-out preventer 402. In a preferred embodiment, a communication module 120 is installed above a flex joint 403 of the subsea structure 400. In another embodiment, the communication module 120 is installed closer to the semi-submersible platform, which can be advantageous for sending commands to the control device 110 during the initial moments after it has been and before it stops to be immersed in the sea.

The positioning stage also includes the step of positioning the assembly (which is arranged during the pre-operation stage) internally to the subsea structure 400 so that the control device 110 and the communication module 120,121 may communicate subsea with each other through the subsea structure 400. This step may include moving the assembly within the subsea structure 400 until it establishes a communication channel with the communication module 120,121. In another embodiment, the step of positioning the assembly may include moving the assembly to a depth at which the establishment of the communication channel is expected to occur. This embodiment is possible given that the hoisting means provided on a floating vessel typically has a depth control that is sufficiently precise for establishing the communication channel.

Moreover, in a system 100 embodiment including a remotely operated vehicle 140 carrying the communication module 121, it is possible to make combinations of method steps involving movements of the assembly within the subsea structure 400 with matching movements of the remotely operated vehicle 140 (and, consequently, of the communication module 121) on the outside of the subsea structure 400. Thus, it is possible to have the remotely operated vehicle 140 move (or "fly") parallelly to the movement of the assembly, while keeping the communication channel between the control device 110 and the communication module 121 in effect during the assembly movement.

In the execution stage, the method includes the steps of:

transmitting a command from the communication module 120,121 to the control device 110, the command identifying a program configured in the memory of the control device 110;

controlling the running tool 200 with the control device 110 so that the at least one operation associated with the identified program is executed;

having the control device 110 process a state identifier for representing a current internal state of the running tool 200; and sending the processed state identifier from the control device 110 to the communication module 120,121.

When the system includes a remote-control device 130 (for example, as shown in FIG. 2) for communicating with the control device 110 via the communication module 120, 121, the remote-control device 130 is also configured with at least one command for identifying a program configured in the memory of the control device 110, and the at least one state identifier representing an operating state of the running tool 200. Thus, the remote-control device 130 can send effective commands to the control device 110 and interpreting the state identifiers received from the control device 110.

The skilled person will know other stages that may be included in the method, such as a stage for pulling the running tool 200 and control device 110 out of the subsea structure 400. This may include a step of commanding the control device 110 to control an adaptation of the running tool 200 into a moving configuration, in which the running tool 200 has all its moving parts retracted.

Generally, the terms used in this description and claims are interpreted according to their ordinary meaning the technical field, unless explicitly defined otherwise. Notwithstanding, the terms "comprises" and "comprising" and variations thereof mean that the specified features, steps or integers are included. These terms are not interpreted to exclude the presence of other features, steps or integers. Furthermore, the indefinite article "a" or "an" is interpreted openly as introducing at least one instance of an entity, unless explicitly stated otherwise. An entity introduced by an indefinite article is not excluded from being interpreted as a plurality of the entity.

The features disclosed in the foregoing description, or in the following claims, or in the accompanying drawings, expressed in their specific forms or in terms of a means for performing the disclosed function, or a method or process for obtaining the disclosed results, as appropriate, may, separately, or in any combination of such features, be utilized for realizing the invention in diverse forms thereof.

While the invention has been described in conjunction with the embodiments described above, many equivalent modifications and variations will be apparent to those skilled in the art when given this disclosure. Accordingly, the embodiments of the invention set forth above are considered to be illustrative and not limiting. Various changes to the described embodiments may be made without departing from the spirit and scope of the invention.

The invention claimed is:

1. A system for remotely controlling a running tool to install equipment in a subsea well through a subsea structure, the system comprising:

a control device configured to control the running tool while being part of an assembly comprising the control device and the running tool, the assembly being movable within the subsea structure and the control device comprising a processing unit, a memory and a first wireless communication interface; and a communication module for wirelessly communicating with the control device, the communication module comprising a second wireless communication interface, wherein the first and the second wireless communication interfaces are configured for subsea communication with each other through the subsea structure when the control device is provided internally to and the communication module is provided subsea and externally to the subsea structure, wherein the memory of the control device is configured with:

at least one state identifier for representing an internal state of the running tool; and at least one program, each program being associated with at least one operation for controlling the running tool, and wherein the control device is configured to carry out the following steps:

receiving a command from the communication module, the command identifying a program configured in the memory of the control device;

executing the at least one operation associated with the identified program;

processing a state identifier for representing a current internal state of the running tool; and sending the processed state identifier to the communication module.

2. The system according to claim 1, wherein each of the first and second wireless communication interfaces comprises a magnetic induction antenna.

3. The system according to claim 2, wherein the system comprises a remotely operated vehicle adapted to carry the communication module.

4. The system according to claim 1, wherein the control device is connected to the first wireless communication interface via a network cable.

5. The system according to claim 4, wherein the system comprises a remotely operated vehicle adapted to carry the communication module.

6. The system according to claim 1, wherein the communication module is configured for installation on an external surface of the subsea structure.

7. The system according to claim 1, wherein the system comprises a remotely operated vehicle adapted to carry the communication module.

8. The system according to claim 1, wherein the system comprises a remote-control device adapted to communicate with the control device via the communication module, the remote-control device comprising a processing unit and a memory configured with:

at least one command for identifying a program configured in the memory of the control device; and the at least one state identifier representing an operating state of the running tool.

9. The system according to claim 8, wherein the remote-control device is adapted to communicate wirelessly, underwater with the communication module.

10. The system according to claim 1, wherein the system comprises at least one energy storage device for providing power to the running tool.

11. A method of remotely controlling a running tool to install equipment in a subsea well through a subsea structure, the method comprising the steps of:

providing the equipment to be set in the subsea well;

providing the running tool;

providing a system according to claim 1;

arranging the equipment, the running tool and the control device of the system into an assembly for the installation of the equipment, wherein the control device is installed for controlling the running tool;

positioning the communication module of the system externally to the subsea structure;

positioning the assembly internally to the subsea structure so that the control device and the communication module may communicate subsea with each other through the subsea structure; and wherein the method further comprises the steps of:

transmitting a command from the communication module to the control device, the command identifying a program configured in the memory of the control device;

controlling the running tool with the control device so that the at least one operation associated with the identified program is executed;

having the control device process a state identifier for representing a current internal state of the running tool; and sending the processed state identifier from the control device to the communication module.

12. The method according to claim 11, wherein the step of positioning the communication module of the system externally to the subsea structure comprises the step of installing the communication module at a fixed location externally to the subsea structure.

13. The method according to claim 12, wherein the step of arranging the equipment, the running tool and the control device of the system into an assembly, comprises the step of:

performing at least one test for confirming that the control device is adapted to control to the running tool.

14. The method according to claim 12, wherein the subsea structure comprises a marine riser and/or a blow-out preventer.

15. The method according to claim 11, wherein the step of providing a system comprises a remotely operated vehicle adapted to carry the communication module, and wherein the step of placing the communication module of the system externally to the subsea structure comprises the step of operating the remotely operated vehicle to place the communication module of the system externally to the subsea structure.

16. The method according to claim 15, wherein the step of arranging the equipment, the running tool and the control device of the system into an assembly, comprises the step of:

performing at least one test for confirming that the control device is adapted to control to the running tool.

17. The method according to claim 15, wherein the subsea structure comprises a marine riser and/or a blow-out preventer.

18. The method according to claim 11, wherein the step of arranging the equipment, the running tool and the control device of the system into an assembly, comprises the step of:

performing at least one test for confirming that the control device is adapted to control to the running tool.

19. The method according to claim 11, wherein the subsea structure comprises a marine riser and/or a blow-out preventer.

20. The method according to claim 11, wherein the equipment is a tubing hanger and the running tool is a tubing hanger running tool.

* * * * *